United States Patent [19]

Corey et al.

[11] 4,013,805

[45] * Mar. 22, 1977

[54] ACID-MODIFIED POLY(VINYL ACETATE) TEXTILE SIZES

[75] Inventors: Albert E. Corey, East Longmeadow; Donald D. Donermeyer, Springfield, both of Mass.

[73] Assignee: Monsanto Company, St. Louis, Mo.

[ * ] Notice: The portion of the term of this patent subsequent to Nov. 11, 1992, has been disclaimed.

[22] Filed: Sept. 19, 1975

[21] Appl. No.: 614,827

Related U.S. Application Data

[62] Division of Ser. No. 406,508, Oct. 15, 1973, Pat. No. 3,919,449.

[52] U.S. Cl. ..... 427/390 R; 260/29.6 TA; 260/30.8 DS; 428/245

[51] Int. Cl.[2] ..... B05D 3/02; D03D 25/00

[58] Field of Search ..... 260/29.6 TA, 30.8 DS; 427/394, 390 R; 428/245

[56] References Cited

UNITED STATES PATENTS 3,919,449 11/1975 Corey et al. ..... 428/245

*Primary Examiner*—Michael R. Lusignan

*Attorney, Agent, or Firm*—R. Bruce Blance; James C. Logomasini; Edward P. Grattan

[57] ABSTRACT

Acid-modified poly(vinyl acetate) textile sizes and textiles sized therewith. The sizes comprise interpolymers of 90.5 to 95.5 percent by weight vinyl acetate, 4.0 to 7.5 percent by weight acrylic acid and 0.5 to 2.0 percent by weight of a monoalkyl ester of maleic, fumaric, or citraconic acids. The interpolymers are prepared preferably by latex interpolymerization. They are used for sizing spun polyester and spun blends of polyester and natural fibers.

8 Claims, No Drawings

ACID-MODIFIED POLY(VINYL ACETATE) TEXTILE SIZES

This is a division of application Ser. No. 406,508, filed Oct. 15, 1973, now U.S. Pat. No. 3,919,449, patented Nov. 11, 1975.

FIELD OF INVENTION

The present invention relates to textile sizes. More particularly, it relates to acid-modified poly(vinyl acetate) textile sizes and to textiles, especially spun polyester textiles sized with these materials.

PRIOR ART

In conventional loom operations, yarn is sized with an aqueous solution of a water-soluble material woven into cloth on a conventional loom with a mechanical shuttle and then the size is removed in a water bath. Many water-soluble compositions are used as textile sizes, for example, poly(vinyl alcohols), carboxymethyl cellulose, starch, styrene-maleic anhydride copolymers, acrylic copolymers and vinyl acetate copolymers. While these sizes have been adequate for natural textile fibers and for many of the synthetic textile fibers, they exhibit deficiencies in the sizing of yarns of spun polyester and spun polyester blended with natural fibers. Poly(vinyl alcohols) lack ease of removability from the sized yarn and are difficult to recover or eliminate from the waste stream. Carboxymethyl cellulose is low in sizing efficiency and difficult to recover from the waste stream. Starch is similar to carboxymethyl cellulose in sizing efficiency and recoverability and is a stronger pollutant because it has a high biochemical oxygen demand. Styrene-maleic anhydride copolymers are deficient in adhesion to spun polyester, being easily shed, leaving the textile fiber unprotected. Acrylic copolymer sizes have good adhesion but are deficient in strength and low in efficiency. Vinyl acetate copolymers are, in general, low in efficiency, and lack ease of removability from the sized yarn.

Thus, there exists in the art a need for a size for spun polyester yarns with adequate adhesion, strength, ease of removability, and ease of recoverability from the water stream.

SUMMARY OF THE INVENTION

The above-mentioned need in the prior art is fulfilled by the present invention which provides acid-modified poly(vinyl acetate) textile sizes which, applied to the yarn as the salt of a monovalent cation, are suitable for use on conventional looms.

The textile sizes of the present invention have excellent solubility characteristics, film properties and adhesion to yarns of spun polyester and polyester fiber blends. Moreover, these sizes are easily removed from sized yarns or the resulting fabric using water or aqueous solutions of inorganic or organic monovalent bases and are readily recovered from the wash solution.

One embodiment of the invention comprises a textile sizing solution of an interpolymer of from 90.5 to 95.5 percent by weight of vinyl acetate, from 4.0 to 7.5 percent by weight of acrylic acid and from 0.5 to 2 percent by weight of a monoalkyl ester of maleic, fumaric, or citraconic acids.

Another embodiment of the invention comprises a process of sizing textile materials by applying to the textile material a textile sizing solution of the above-described interpolymer.

Another embodiment of the invention comprises textile materials sized with the above-described interpolymer.

PREFERRED EMBODIMENTS

The sizes of the present invention are prepared by interpolymerizing vinyl acetate, acrylic acid and a monoalkyl ester of maleic, fumaric, or citraconic acids in which the alkyl group contains from 1 to 8 carbon atoms. Examples of such monoalkyl esters include mono-methyl maleate, monomethyl fumarate, monomethyl citraconate, mono-ethyl maleate, monoethyl fumarate, mono-n-propyl maleate, mono-isopropyl fumarate, mono-n-butyl maleate, mono-iso-butyl fumarate, mono-t-butyl citraconate, mono-n-hexyl maleate, mono-iso-hexyl fumarate, mono-n-octyl maleate, mono-n-octyl fumarate, mono-n-octyl citraconate, mono-iso-octyl maleate, mono-2-ethyl hexyl maleate and mono-2-ethyl hexyl fumarate. Preferred monoalkyl esters are monoalkyl maleates or fumarates in which the alkyl group contains from 1 to 4 carbon atoms, such as monomethyl maleate, monoethyl fumarate, mono-n-propyl maleate and mono-n-butyl maleate since these monoalkyl esters are associated with acceptable rates of interpolymerization and more rapid solution of the resulting interpolymers. The interpolymers contain between 90.5 and 95.5 percent by weight of vinyl acetate, between 4.0 and 7.5 percent by weight of acrylic acid and between 0.5 and 2 percent by weight of the monoalkyl ester. Thus, the total acid monomer is in the range from 4.5 to 9.5 percent by weight. Below 4.5 percent by weight, the solubility or the rate of solution of the interpolymer is unsatisfactory. Above 9.5 percent by weight, the interpolymer lacks water resistance.

It is a feature of the present invention that while the acid monomers of the interpolymer are preponderantly acrylic acid, a minor fraction comprises the monoalkyl esters set forth hereinbefore. This minor fraction of monoalkyl ester has been found to impart improved solubility and improved rate of solution to the interpolymer composition thus improving the efficiency of removal of the interpolymer size from woven goods, when the size is used as a warp yarn size. This improved solubility is achieved with between 0.5 and 2 parts by weight of mono-alkyl ester per 100 parts by weight of interpolymer.

The monomers are preferably polymerized using latex polymerization methods at a temperature in the range of from 40° to 60° C. and preferably at a temperature in the range of from 40° to 45° C. At temperatures below about 40° C. the polymerization rate is too slow and the reaction mass tends to coagulate. At polymerization temperatures above 60° C., the product tends to low molecular weight and lacks the tensile strength and elongation required in the sizes of the present invention. The molecular weight of the interpolymer should be such that the specific viscosity of a 1 percent solution of interpolymer in dimethyl sulfoxide at 25° C. is in the range from 1.5 to 12.0 and more preferably for adequate strength and solubility, it should be such that the specific viscosity is in the range from 1.8 to 6.0. Solubility is determined by the solution rate of a film of interpolymer as described herein.

The interpolymerization is carried out using a surfactant which comprises a phosphate ester of an alkyl phenol-ethylene oxide condensate wherein the alkyl group contains from 7 to 11 carbon atoms. Especially preferred are the phosphate esters of tertiary octyl phenol-ethylene oxide condensates (hereinafter referred to as PEOPEO) and the phosphate esters of nonyl phenolethylene oxide condensates (PENPEO). These preferred surfactants are available commercially as Triton XQS surfactants (Rohm & Haas Company) and GAFAC surfactants (General Aniline & Film Company), respectively. The amount of the phosphate ester of an alkyl phenol-ethylene oxide condensate used will be in the range of from 1.0 to 4.0 percent by weight based on the total weight of the latex.

In a more preferred embodiment of the invention, the latex interpolymerization of the monomers is carried out using an anionic co-surfactant in combination with the phosphate esters of an alkyl phenol-ethylene oxide condensate. The use of the co-surfactant reduces the amount of coagulum in the resulting latex and provides a better product. The preferred co-surfactants used in the present invention include alkyl sulfonates such as sodium dodecyl benzene sulfonate; fatty alcohol sulfates such as sodium lauryl sulfate; dialkyl sulfosuccinates such as sodium dihexyl sulfosuccinate; etc. The amount of co-surfactant used is in the range of 0.3 to 1.0 percent by weight and more preferably 0.40 to 0.60 percent by weight based on the total weight of the latex. The co-surfactant is preferably added continuously during the polymerization reaction.

The latex polymerization processes are initiated by a two component redox free radical initiator system. Suitable oxidizing components for the system are the inorganic peracid salts such as ammonium, potassium and sodium persulfates, perborates, and hydrogen peroxide. Preferred, however, are the oil soluble organic hydroperoxides such as t-butyl hydroperoxide, cumene hydroperoxide, p-menthane hydroperoxide, etc. and esters of the t-butyl perbenzoate type. The useful reducing components include compounds like the sulfites, bisulfites, hydrosulfites and thiosulfates; ethyl and other alkyl sulfites; the sulfoxylates, such as sodium formaldehyde sulfoxylate; and the like. Especially preferred are initiator systems based on t-butyl hydroperoxide and sodium formaldehyde sulfoxylate; and redox combinations such as mixtures of hydrogen peroxide and an iron salt, hydrogen peroxide and zinc formaldehyde sulfoxylate or other similar reducing agent; hydrogen peroxide and a titanous salt; potassium persulfate and sodium bisulfite and a bromate mixed with a bisulfite.

The use of equimolar amounts of initiator system components is generally preferred although the amount of each component as well as the total amount of catalyst used depends on the type of component used as well as on other polymerization conditions and may range between .02 and 0.4 percent by weight of the total polymerization system, the preferred range being 0.03 to 0.20 percent for the oxidizing component and 0.04 to 0.20 for the reducing component.

The solids contents of the interpolymer latices can be varied over a wide range. The preferred latices having a solids content in the range of from 15 to 65 percent by weight and more preferably from 35 to 55 percent by weight, based on the total weight of the latex.

During the polymerization reaction, a conventional base such as ammonium hydroxide or sodium hydroxide is used to buffer the latex to a pH in the range of 4.0 to 6.0.

The textile size solution may be prepared from an inter-polymer latex in several ways. In one method, an aqueous solution of base is mixed with the latex to dissolve the interpolymer by formation of the water soluble interpolymer carboxylate. Suitable bases include the hydroxides, carbonates and bicarbonates of alkali metals such as sodium hydroxide, sodium carbonate and sodium bicarbonate; ammonia, organic bases such as methylamine, dimethylamine, trimethylamine, ethylamine, diethylamine, triethylamine, morpholine, etc. The preferred based in the preparation of a loom finish size is ammonium hydroxide since it contributes to good adhesion and resistance to water, water spotting and dry cleaning. The preferred base in the preparation of removable warp yarn size is sodium carbonate since it contributes to rapid solution of the interpolymer, good adhesion of the interpolymer size to spun polyester yarn and rapid removability of the size from the woven goods. A particular advantage of the interpolymer latex is that the fine size of the interpolymer particles allows rapid solubility of the interpolymer in aqueous base to form the size solution.

Another method for preparation of the textile size solution comprises the recovery of the interpolymer from the latex by conventional means and solution of the interpolymer in an organic solvent. The size is then applied to the textile yarn as an organic solution and may be removed from the woven goods with aqueous base or organic solvent.

Preferred organic solvents for preparation of size solutions and removal of size are alcohols, ketones, esters and aromatic solvents. Especially preferred are chlorinated aliphatic hydrocarbons such as methylene chloride, methylene bromide, chloroform, bromoform, ethylene dichloride, ethylene dibromide, ethylidene chloride, ethylidene bromide, s-tetra-chloroethane, hexachloroethane, s-dichloroethylene, 1,1,1-trichloroethane, 1,1,2-trichloroethane, trichloroethylene, trimethylene bromide, trichlorobromoethane, trichloromethane, 1,2,3-trichloropropane, 1,1,2-trichloropropane, trifluoro-1,1,2-tribromoethane, trifluoro-1,1,2-trichloroethane, 2,2-dichloro-1-bromoethane, 1,3-dichloro-2-methylpropane, 1,2-dichloro-2-methyl-propane, 1,1-diiodoethane and the like. Chlorinated aliphatic liquid hydrocarbons are preferred in the practice of this invention because of their generally lower cost, greater availability, non-flammability, low toxicity and ease of recovery.

A further advantage of the interpolymer compositions lies in their recoverability. The aqueous solutions of the interpolymer obtained by scouring of the sized goods are acidified with strong acid to a pH less than about 3.5. The interpolymer is precipitated and recovered by conventional means such as filtration or centrifugation. It is then redissolved in aqueous alkaline solution or organic solvent to form fresh sizing solution.

The following examples are set forth in illustration of the present invention and should not be construed as a limitation thereof. Unless otherwise indicated, all parts and percentages given are by weight.

PART A—PREPARATION OF LATICES

EXAMPLE 1

A latex is prepared in a conventional latex polymerization kettle equipped with an agitator and a heating and cooling system. The charges listed in Table I are used.

Water and sodium hydroxide are charged to the reaction vessel. The solution is purged for 15 minutes to remove oxygen. The PEOPEO surfactant and sodium formaldehyde sulfoxylate are added to form Charge A. Charges B and C are prepared by adding t-butyl hydroperoxide solution and sodium dihexyl sulfosuccinate to the respective quantities of monomers. Charge B is then dispersed in Charge A. The batch is mildly agitated and maintained at 42° to 44° C. while Charge C is added over 2½ hours.

The resulting latex has a total solids of 43.0 percent, a pH of 4.9 and a Brookfield viscosity of 27 cps. at 25° C. The coagulum is 0.11 weight percent of the solids. The interpolymer has a specific viscosity of 2.30 in dimethyl sulfoxide at a concentration of 1 g. per 100 ml. The properties of the latex interpolymer are tabulated in Table I below.

EXAMPLES 2 to 6

The following Examples 2 to 6 are set forth in illustrate variations in the latex polymerization of the present invention. In each case, the general procedures of Example 1 are followed except for the noted changes. Polymerization temperatures are maintained in the range from 41° to 45° C. The resulting latices have solids contents in the range of 40 to 47 percent by weight, pH in the range of 4.5 to 5.5, and Brookfield viscosities in the range from 10 to 150 cps. at 25° C. The examples are tabulated in Table I.

Adhesion values are the loads in pounds required to break 1 × ½ inch Mylar polyester film lap joints adhered with 2.0 mil film of interpolymer. Experience has shown that an adhesion value of at least 80 pounds is required for satisfactory size performance with spun polyester woven on a commercial machine.

EXAMPLES 7 to 11

The following examples are set forth to illustrate the use of various acid comonomers in the preparation of the interpolymer latices. The latices are prepared by the procedure described in Example 1. Composition data for the interpolymers are presented in Table II. In every case, a satisfactory latex and textile size is obtained.

TABLE II

| EXAMPLE | EXAMPLES 7–11 7 | 8 | 9 | 10 | 11 |
|---|---|---|---|---|---|
| Polymer Wt. % of Latex | 30 | 48 | 30 | 43 | 43 |
| Weight Ratio of Monomers | | | | | |
| Vinyl acetate | 90.5 | 95.0 | 90.5 | 93.0 | 93.0 |
| Acrylic acid | 7.5 | 4.0 | 7.5 | 6.0 | 6.0 |
| Mono-n-octyl-maleate | 2.0 | | | | |
| Monomethyl fumarate | | 0.5 | | | |
| Mono-iso-octyl fumarate | | | 2.0 | | |
| Mono-isopropyl maleate | | | | 1.0 | |
| Mono-n-amyl citraconate | | | | | 1.0 |

TABLE I

| EXAMPLE | EXAMPLES 1-6, COMPOSITION AND PROPERTIES 1 | 2 | 3 | 4 | 5 | 6 |
|---|---|---|---|---|---|---|
| Charge A (parts by weight) | | | | | | |
| Water | 54.41 | 54.41 | 51.91 | 52.24 | 51.91 | 54.41 |
| Sodium hydroxide | 0.18 | 0.18 | 0.18 | 0.18 | 0.18 | 0.18 |
| PEOPEO (70%) | 2.25 | 2.25 | 2.25 | 2.25 | 2.25 | 2.25 |
| Sodium formaldehyde sulfoxylate | 0.102 | 0.102 | 0.102 | 0.102 | 0.102 | 0.102 |
| Charge B (parts by weight) | | | | | | |
| t-butyl hydroperoxide (90%) | 0.0043 | 0.0043 | 0.0039 | 0.0039 | 0.0039 | 0.0041 |
| Vinyl acetate | 2.75 | 2.75 | 2.63 | 2.64 | 2.61 | 2.62 |
| Acrylic acid | 0.015 | 0.015 | 0.147 | 0.148 | 0.155 | 0.147 |
| Monomethyl maleate | 0.023 | 0.023 | 0.022 | 0.021 | 0.042 | 0.033 |
| Sodium dihexyl sulfosuccinate | 0.034 | 0.034 | 0.031 | 0.016 | 0.031 | 0.033 |
| Charge C (parts by weight) | | | | | | |
| t-butyl hydroperoxide | 0.058 | 0.058 | 0.058 | 0.058 | 0.058 | 0.058 |
| Vinyl acetate | 37.18 | 37.18 | 39.65 | 39.66 | 39.19 | 37.15 |
| Acrylic acid | 2.22 | 2.22 | 2.21 | 2.21 | 2.33 | 2.08 |
| Monomethyl maleate | 0.32 | 0.32 | 0.34 | 0.32 | 0.63 | 0.46 |
| Sodium dihexyl sulfosuccinate | 0.47 | 0.47 | 0.47 | 0.47 | 0.47 | 0.47 |
| Monomer Weight Ratio | | | | | | |
| Vinyl acetate | 93.95 | 93.95 | 93.95 | 94.00 | 93.0 | 93.58 |
| Acrylic acid | 5.25 | 5.25 | 5.25 | 5.25 | 5.5 | 5.25 |
| Monomethyl maleate | 0.80 | 0.80 | 0.80 | 0.75 | 1.5 | 1.17 (MBM)[a] |
| Latex Solids, Weight Percent | 43.0 | 44.7 | 46.1 | 45.8 | 46.4 | 42.8 |
| Polymer Properties[b] | | | | | | |
| Specific viscosity | 2.30 | 1.76 | 3.30 | 3.07 | 3.20 | 3.59 |
| Tensile strength, psi, 65% R. H. | 2830 | 3170 | 2820 | 3270 | 2650 | 3000 |
| Elongation, %, 65% R. H. | 300 | 70 | 450 | 420 | 470 | 17 |
| Tensile strength, psi, 80% R. H. | 2460 | 2750 | 2340 | 2630 | 1890 | 2250 |
| Elongation, %, 80% R. H. | 630 | 570 | 640 | 560 | 670 | 560 |
| Polyester adhesion, lbs. | 290 | 170 | 240 | 230 | 250 | 175 |

[a]MBM - mono-n-butyl maleate
[b]Tensile properties determined with the ammonium salt.

In the foregoing Table I, specific viscosity measurements are determined on solutions of interpolymer in dimethyl sulfoxide (1 g. per 100 ml.) at 25° C.

Tensile strength and elongation are measured according to ASTM Method D-882-67 on films of interpolymer cast from aqueous solutions neutralized with sodium carbonate or ammonium hydroxide. The test specimens are conditioned at 65 and 80 percent relative humidity.

PART B—TESTING OF THE LATICES AS TEXTILE SIZES

The latices prepared in Examples 1 to 5 are tested in order to determine their suitability as yarn sizes in conventional weaving processes. The sizes are prepared by dissolving the latex in a basic solution such as aqueous sodium carbonate, aqueous sodium hydroxide or aqueous ammonia.

The key properties considered in these tests are listed below:

Sizing Solutions prepared from the latices of Examples 1 to 6 by solution in aqueous ammonia, sodium hydroxide or sodium carbonate have Brookfield viscosities in the range of from 5 to 500 centipoises at 5 to 20 percent solids at a temperature of 170° F. allowing easy application and control of the amount of size added to the yarn. Viscosities determined at 25° C. on solutions containing 10 weight percent of interpolymer are used for comparison of the interpolymers. In general, a viscosity of at least 200 cps. at 25° C. in a 10 weight percent solution is preferred to provide adequate viscosity in the sizing solution at the higher temperatures conventionally used in sizing textile yarns.

Adhesion solutions of the latex interpolymers of Examples 1–6 have been tested and are found to have good adhesion to the following yarns — Filaments: polyester, acetate, rayon and texturized polyester; Spun: polyester, rayon, cotton, wool, and blends of polyester with rayon, cotton and wool.

Solubility in Organic Solvent size solutions of interpolymer latex in aqueous ammonia are applied to yarn and dried. The dried films are readily soluble in chlorinated hydrocarbons.

Solubility in Aqueous Solvent five mil films are cast either from ammonia or sodium carbonate solutions of interpolymer. Two square inch samples of film are weighed. The samples are immersed in 100 g. of solvent and stirred with a magnetic stirrer at a rate sufficient to create a slight vortex. The time taken for the samples to dissolve at 80°±2° C. is determined. For films cast from sodium carbonate solutions, the solvent is water; for films cast from ammonium hydroxide, the solvent is 0.25 weight percent aqueous sodium hydroxide. Based on the assumption that the rate of solution is constant over the time taken for solution, rates are calculated and are given as milligrams per square centimeter minute.

Size Efficiency is a measure of the amount of size add-on required in a given operation. The add-on is the amount of size that must be applied to the yarn in order to permit it to be woven on a loom. In general, the less size add-on required, the more efficient the size. Sizes prepared from the latices of the present invention have high efficiency as is indicated by the following Examples 12–15.

Weaving Efficiency is a measure of efficiency of weaving of the sized warp yarn into a cloth or sheet construction. It is expressed as a percentage ratio of the number of yards woven in unit time versus the number of yards which would be woven if the loom had no stops in the unit of time.

EXAMPLE 12

An 8 percent solution of the interpolymer latex of Example 3 is made by dissolving 210 pounds of latex (46.1%) diluted to proper solids with 6 pounds ammonium hydroxide (28%). The mix is heated for 20 minutes at 190° F. and is diluted to 125 gallons. The size solution thus obtained is applied at 170° F. to a 27/1,50/50 polyester-cotton yarn on a 10-can West Point Slasher, with cans set at 240° F. The Slasher is run at 88 yards per minute, 13 yards per minute faster than a conventional polyvinyl alcohol size. Size add-on is 10.4 weight percent. The split is easy, with no can sticking or ends out during doffing and leasing. The warp is woven on a DSL loom at a high efficiency equivalent to that obtained with a conventional hydrolyzed polyvinyl alcohol size.

EXAMPLE 13

A 9.5 percent solution of the interpolymer latex of Example 4 is made by dissolving 380 pounds of latex (41%) with 20 pounds of $NH_4OH$ (28%) to pH 9.2. Seven pounds of mill wax and one-half pound defoamer are added after solution of the interpolymer is complete. The solution is diluted with water to yield 200 gallons of sizing solution. The sizing solution is applied to a 39/1,65/35 Polyester/Rayon blend on a 9-can West Point Slasher. Cans 1–8 are run at 235° F., the 9th can at ambient temperature. The Slasher is run at 45 yards per minute at 170° F. Size add-on is 10.8%. The warp is free of can sticking or ends out during leasing. The solution is free of skinning during slashing. The warp is woven at 93% efficiency in a 88 × 60 bastiste weave. The warp is desized in ¼% NaOH at 180° F. The woven goods are uniformly receptive to dye and give the same dye shade as goods obtained from warp sized with easily removed carboxymethyl cellulose.

EXAMPLE 14

A 9.7% solution is prepared by dissolving 210 pounds of the latex of Example 3 in 5 pounds of sodium carbonate dissolved in 85 gallons of water. Five pounds of a mill wax and 1 pound of defoamer are added after the latex has dissolved. The mix is diluted to 125 gallons. Size solution is applied to a 26/1,50/50 polyester/cotton warp at 175° F. on a 9-can Cocker Slasher run at 75 yards per minute. Can temperatures are 250° F. except for first can which is set at 220° F. The split is easy with no can sticking, skinning or ends out during leasing. Size add-on is 11.8%. The warp is woven into a sheet construction on a DSL loom at high efficiency.

EXAMPLE 15

An 8 percent solution is prepared by dissolving 275 pounds of a 46% latex of composition similar to Example 4 in 6 pounds of sodium carbonate dissolved in 150 gallons of water and finished to 200 gallons. The size is applied to 30/1 spun polyester yarn at 11% add-on. The warp weaves at high efficiency and is desized readily in water containing the usual wetting agents employed in textile desizing.

Sizes which are obtained from polymers prepared by the process of the present invention are compared to commercially available textile sizes. The sizes are prepared in the form of aqueous solutions of the sodium salt or ammonium salt and are cast as films. The films are dried and tested at 65 percent relative humidity at 72° F. for tensile strength and elongation. Solubility rates are determined by the method set forth above. Data are presented in Table III.

TABLE III

| Size | Composition[1] | COMPARISON OF SIZE PROPERTIES Solution Viscosity 10 Wt. % (25° C.) | Specific Viscosity | Tensile Strength (psi) | Elongation (%) | Solubility Rate (mg/cm² min.) | Polyester Adhesion (lbs.) |
|---|---|---|---|---|---|---|---|
| A | VA/AA/MMM 93.95/5.25/0.8 | 1850 | 2.30 | 2830 (1660) | 300 (780) | 6 (12) | 290 |
| B | VA/AA/MBM 93.48/5.25/1.27 | 7000 | 3.59 | 3000 | 17 | 12 | 175 |
| C | VA/VP/AA 70/25/5 | 33 | 2.44 | (1350) | (370) | (12) | — |
| D | VA/AA 95.5/4.5 | 36000 | 2.97 | 3400 | 440 | 0.6 | 150 |
| E | VA/AA/DMM 88/5/7.5 | >100,000 | 3.35 | 4270 | 11 | 0.9 | 90 |
| F | Starch | — | — | — | — | 0 | 0 |
| G | PVOH | 670 | — | 6530 | 240 | 2.5 | 50 |
| H | CMC | >100,000 | — | 9290 | 39 | 9–10 | 30 |

[1]Composition is given in ratios by weight.
Note:
VA=vinyl acetate; AA=acrylic acid; MMM=monomethyl maleate; MBM=mono-n-butyl maleate;
VP=vinyl propionate; DMM=dimethyl maleate; PVOH=poly(vinyl alcohol); CMC=carboxymethyl cellulose.
Data in parenthesis are for the sodium salt; all other data are for the ammonium salt.

Sizes A and B are obtained from latices prepared in the manner described in Examples 1 and 6, respectively. Sizes C to H are commercially available sizes representative of the prior art. Sizes A and B exhibit high solution viscosity necessary for controlled add-on to spun polyester yarns and high solution rates for economic desizing. The solution viscosity of Size C is too low for economical add-on of size to spun polyester, while the solution rates of Sizes D, E, F, and G are too low for economic desizing. Carboxymethyl cellulose has an acceptable solution rate. However, it is inefficient as a size because of low adhesion to polyester and it is difficult to recover from waste water.

EXAMPLE 16

A latex composition is prepared as in Example 1 and coagulated by addition of acetone. The interpolymer is recovered and dried. It is then dissolved in trichloroethylene to give a 8.0 percent solution. The solution is used to size spun polyester yarn.

EXAMPLE 17

A latex composition is prepared as in Example 1. The resulting latex is dissolved in aqueous ammonia to give a 8.0 percent solution of interpolymer having a pH of 9.0. The solution is used to size spun polyester yarn. The sized warp yarn is woven on a conventional loom. Size is removed from the woven goods by extraction with 1,1,1-trichloroethylene.

The sizes of the present invention may be formulated with lubricants, defoamers, humectants, plasticizers, softening agents and other adjuncts without departing from the scope of the invention.

From the foregoing, it should be obvious that many variations are possible in the present invention without departing from the spirit and scope thereof.

What is claimed is:

1. A method for sizing textiles which comprises applying to the textile material an aqueous solution of the interpolymerization product of from 90.5 to 95.5 weight percent of vinyl acetate, from 4.0 to 7.5 weight percent of acrylic acid and from 0.5 to 2.0 weight percent of a monoalkyl ester of maleic, fumaric, or citraconic acids in which the alkyl group contains from 1 to 8 carbon atoms; wherein the solvent portion of the solution is an aqueous solution of a base selected from the group consisting of hydroxide carbonates and bicarbonates of alkali metals, ammonia, methylamine, dimethylamine, trimethylamine, ethylamine, diethylamine, triethylamine and morpholine.

2. The method of claim 1 wherein the solvent portion of the solution is an aqueous solution of sodium carbonate.

3. The method of claim 1 wherein the solvent portion of the solution is an aqueous solution of ammonia.

4. The method as in claim 1 wherein the interpolymerization product is obtained by latex interpolymerization.

5. The method as in claim 1 wherein the monoalkyl ester is a monoalkyl maleate or fumarate in which the alkyl group contains from 1 to 4 carbon atoms.

6. The method as in claim 1 wherein the monoalkyl ester is monomethyl maleate, monomethyl fumarate, monoethyl maleate or monoethyl fumarate.

7. The method as in claim 1 wherein the interpolymer in dimethyl sulfoxide at a concentration of 1 gram per 100 ml. has a specific viscosity in the range of from 1.5 to 12.0 at 25° C.

8. The method as in claim 1 wherein the size contains from 1 to 25 percent by weight of interpolymer based on the total weight of the aqueous solution.

* * * * *